US010109954B2

(12) United States Patent
Shimizu et al.

(10) Patent No.: US 10,109,954 B2
(45) Date of Patent: Oct. 23, 2018

(54) LEVER-TYPE CONNECTOR

(71) Applicant: YAZAKI CORPORATION, Tokyo (JP)

(72) Inventors: Tomohiko Shimizu, Makinohara (JP); Shogo Suzuki, Makinohara (JP); Hidenori Kanda, Makinohara (JP); Masayuki Saito, Makinohara (JP); Takuya Hasegawa, Fujieda (JP); Kazuya Terao, Fujieda (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/696,401

(22) Filed: Sep. 6, 2017

(65) Prior Publication Data

US 2018/0069346 A1 Mar. 8, 2018

(30) Foreign Application Priority Data

Sep. 7, 2016 (JP) ..... 2016-174969

(51) Int. Cl.

| | |
|---|---|
| ***H01R 13/639*** | (2006.01) |
| ***H01R 13/502*** | (2006.01) |
| ***H01R 13/629*** | (2006.01) |
| *H01R 107/00* | (2006.01) |

(52) U.S. Cl.

CPC ..... *H01R 13/639* (2013.01); *H01R 13/502* (2013.01); *H01R 13/62938* (2013.01); *H01R 13/62955* (2013.01); *H01R 2107/00* (2013.01)

(58) Field of Classification Search

CPC ..... H01R 13/62938; H01R 13/639; H01R 13/502

USPC ..... 439/157, 312

See application file for complete search history.

(56) References Cited

U.S. PATENT DOCUMENTS

| | | | | |
|---|---|---|---|---|
| 5,230,635 A | | 7/1993 | Takenouchi et al. | |
| 5,474,462 A | | 12/1995 | Yamanashi | |
| 5,509,816 A | * | 4/1996 | Katsuma | H01R 13/62938 439/153 |
| 5,551,885 A | | 9/1996 | Yamanashi et al. | |
| 5,611,703 A | * | 3/1997 | Okamoto | H01R 13/62933 439/153 |

(Continued)

FOREIGN PATENT DOCUMENTS

| | | |
|---|---|---|
| JP | 5-129048 A | 5/1993 |
| JP | 2008-226535 A | 9/2008 |

(Continued)

OTHER PUBLICATIONS

Office Action dated Jul. 24, 2018 by the Japanese Patent Office in counterpart Japanese Patent Application No. 2016-174969.

*Primary Examiner* — Harshad C Patel
(74) *Attorney, Agent, or Firm* — Sughrue Mion, PLLC

(57) ABSTRACT

A lever-type connector includes a housing configured to be inserted and removed from a mating housing of a mating connector and a lever. The lever is pivotally operable between a temporary locking position and a fitting completion position of the lever. The lever includes a pair of side plates and an operating portion. A lock portion is provided on the housing. Lever disengagement prevention portions are provided on both sides of the housing so as to cover at least respective parts of the side plates of the lever positioned at the fitting completion position from outside.

5 Claims, 9 Drawing Sheets

(56) References Cited

U.S. PATENT DOCUMENTS

| | | | | |
|---|---|---|---|---|
| 6,217,354 | B1 * | 4/2001 | Fencl | H01R 13/62977 439/157 |
| 6,413,105 | B2 * | 7/2002 | Noro | H01R 13/62938 439/157 |
| 6,447,312 | B1 * | 9/2002 | Takata | H01R 13/62938 439/157 |
| 6,679,711 | B2 * | 1/2004 | Takahashi | H01R 13/62938 439/153 |
| 7,004,769 | B1 * | 2/2006 | Putnam | H01R 13/62977 439/157 |
| 7,559,780 | B2 * | 7/2009 | Mizoguchi | H01R 13/62938 439/157 |
| 7,959,452 | B2 * | 6/2011 | Komiyama | H01R 13/62977 439/157 |
| 2006/0040534 | A1 * | 2/2006 | Flowers | H01R 13/4364 439/157 |
| 2012/0129381 | A1 * | 5/2012 | Makino | H01R 13/62938 439/372 |
| 2013/0230994 | A1 | 9/2013 | Kamiya | |
| 2015/0037089 | A1 * | 2/2015 | Kamiya | H01R 13/62938 403/322.4 |

FOREIGN PATENT DOCUMENTS

| | | | |
|---|---|---|---|
| JP | 2012-69415 | A | 4/2012 |
| JP | 2012-89302 | A | 5/2012 |

* cited by examiner

LEVER-TYPE CONNECTOR

CROSS REFERENCE TO RELATED APPLICATIONS

This application is based on Japanese Patent Application (No. 2016-174969) filed on Sep. 7, 2016, the contents of which are incorporated herein by reference.

BACKGROUND OF THE INVENTION

1. Field of the Invention

The present invention relates to a lever-type connector.

2. Description of the Related Art

Conventionally, a lever-type connector is known that can perform a connector fitting with a low insertion force due to a rotational force by rotating a lever pivotally mounted on a housing so that the connector is fitted to a mating housing of a mating connector (see, for example, JP-A-2012-69415).

In this lever-type connector, the housing is fitted into the mating housing, and thereafter the lever is pivoted from a fitting start position to a fitting completion position, and by engaging and locking to a lock portion of the housing, and thereby the housing maintains a state in which the connector is fitted to the mating housing.

When an external force such as a vibration or shock is applied to the mating connector, the lever rattles with respect to the housing, and an abnormal noise may be generated or the engagement of the lever by the lock portion of the housing may loosen, and the reliability of the fitting with the mating connector may deteriorate.

SUMMARY OF THE INVENTION

The present invention has been made in view of the above circumstances, and its objective is to provide a lever-type connector capable of suppressing backlash of the lever with respect to the housing and achieving high reliability in fitting with a mating connector.

In order to achieve the above objective, the lever-type connector according to the present invention is characterized by (1) to (6) below.

(1) A lever-type connector, including:

a housing configured to be inserted and removed from a mating housing of a mating connector;

a lever, pivotally mounted on the housing, and that is pivotally operable between a temporary locking position and a fitting completion position of the lever, the lever comprising:

a pair of side plates arranged along surfaces on both sides of the housing; and an operating portion that connect ends of the side plates; and a lock portion, provided on the housing, and that locks the lever positioned at the fitting completion position, wherein the housing is configured to be fitted to the mating housing by rotating the lever from a fitting start position to a fitting completion position; and wherein lever disengagement prevention portions are provided on both sides of the housing so as to cover at least respective parts of the side plates of the lever positioned at the fitting completion position from outside.

(2) The lever-type connector (10) according to (1), wherein inner surfaces of the lever-disengagement prevention portions respectively contact with vibration-suppressing protrusions provided on the side plates of the lever when the lever positioned at the fitting completion position.

(3) The lever-connector according to (1) or (2) above, wherein the housing has a pair of walls that are provided at both sides of the lock portion for locking the operating portion of the lever;

wherein recessed portions that externally fit the pair of walls of the housing are formed on the operating portion of the lever; and wherein inner surfaces of the recessed portions contact outer surfaces of the pair of walls facing the inner surfaces respectively when the lever is positioned at the fitting completion position.

(4) The lever-type connector according to (3), wherein a backlash-eliminating protrusion is provided on either the inner surfaces of the recess portions or the outer surfaces of the pair of walls.

(5) The lever-type connector according to any one of (1) to (4), wherein locking protrusions are formed on inner surfaces of the side plates of the lever so as to lock the lever to the temporary locking position with respect to the housing;

wherein escape grooves are formed on both side surfaces of the housing so that the locking protrusions are in a non-contact state with the housing when the lever is rotated; and wherein ends of the escape grooves have final locking surfaces respectively on which the locking protrusions ride and are engaged when the lever is moved to the fitting completion position.

(6) The lever-type connector according to any one of (1) to (5), wherein locking pieces are provided at tip ends of the support shafts, projecting from both sides of the housing, to pivotally support the lever, the locking pieces extending in directions intersecting axes of the support shafts;

wherein each of pivot holes through which the locking piece is inserted and having an opening shape corresponding to outer shape of the locking piece is provided in respective one of the side plates to pivotally support the support shafts; and wherein pressed protrusions, configured to be pressed by inner surfaces of the locking pieces when the lever is moved to the fitting completion position, are provided adjacent to the pivot holes of the lever.

In the lever-type connector of the above configuration, when the housing is fitted into the mating housing and the lever at the fitting start position is rotated and moved to the fitting completion position, the housing is fitted to the mating housing and the lever is engaged and locked to the lock portion.

In this state, since the vibration suppressing protrusions, which are a part of the side plates of the lever, are covered from the outside by the lever-disengagement prevention portions provided on both sides of the housing, disengagement of the side plate from the housing is prevented in the lever that is engaged and locked to the lock portion in the fitting completion position. As a result, even if an external force such as vibration or shock is applied to the lever, the lever can be engaged and locked by the lock portion, thus high fitting reliability with the mating connector can be achieved.

In the lever-type connector having the above configuration, when the lever is moved to the fitting completion position, the inner surface of the lever-disengagement prevention portion is pressed against the vibration suppressing protrusions provided on the side plate of the lever (a state of no gaps or pressurized contact). Therefore, the lever, in which the side plates do not rattle with respect to the lever disengagement prevention portion, does not generate abnormal noise even when vibrations are applied.

In the lever-type connector having the above configuration, when the lever is moved to the fitting completion position, the recessed portions of the operating portion are externally fitted to the pair of the walls on both sides of the lock portion without any gaps (a state of no gaps or pressurized contact). Therefore, it is possible to further suppress backlash of the operating portion of the lever engaged and locked to the lock portion in the fitting completion position. As a result, even if an external force such as vibration or shock is applied, the lever can be engaged and locked by the lock portion, thus high fitting reliability with the mating connector can be achieved.

In the lever-type connector of the above configuration, when the lever is placed in the fitting completion position, the backlash-eliminating protrusions protruding from either the outer surfaces of the pair of walls or the inner surfaces of the recessed portions are compressed and deformed in a state where the recessed portions of the operating portion are pressed against the pair of walls. By backlash-eliminating protrusions which are easy to compress and deform, it is possible to easily suppress backlash of the operating portion of the lever engaged and locked to the lock portion in the fitting completion position.

In the lever-type connector having the above configuration, the locking protrusions on the inner surfaces of the side plates of the lever can lock the lever to the housing in the temporary locking position. Therefore, it is possible to prevent careless rotation of the lever before fitting to the mating connector and eliminate complicated operations in returning the carelessly rotated lever to the temporary locking position, thus, making it possible to smoothly perform the fitting to the mating connector.

When rotating the lever, by way of the locking projections on the inner surface of the side plates of the lever passing through the escape grooves formed in the side surfaces of the housing, the lever is smoothly pivoted in a predetermined direction without the locking protrusions coming in contact with the side surfaces of the housing. Then, when the lever is moved to the fitting completion position, the locking protrusion of the lever rides on the locking surface of the escape groove and suppresses backlash of the lever. As a result, even if an external force such as vibration or shock is applied, the lever can be engaged and locked by the lock portion more securely, thus high fitting reliability with the mating connector can be achieved.

In the lever-type connector of the above configuration, when at least the lever is moved to the fitting completion position, the inner surface of the locking piece formed on the support shaft protruding on both sides of the housing presses the pressed protrusion, formed in the vicinity of the pivot hole in the side plate, toward the side of the housing. Therefore, in the side plates of the lever, backlash of the support shaft of the housing is suppressed, and generation of noise from vibrations are prevented.

According to the present invention, it is possible to provide a lever-type connector that suppresses backlash of a lever and obtains a high fitting reliability with a mating connector.

The present invention has been briefly described above. Furthermore, details of the present invention will be further clarified by reading about the forms for carrying out the invention (hereinafter referred to as "embodiments") described below with reference to the attached drawings.

BRIEF DESCRIPTION OF THE DRAWINGS

FIGS. 4A and 4B are enlarged views of the main portion illustrating the side plate of the lever pivotally supported by a support shaft of the housing, in which FIG. 4A shows a state where the lever is in a temporary locking position, and FIG. 4B shows a state where the lever is in the fitting completion position.

FIGS. 7A and 7B are explanation views that describe the movement of the locking protrusion and the cam boss in accordance with rotation of the lever, wherein FIG. 7A shows a state before the housing is fitted to the mating connector, and FIG. 7B shows a state in which the housing is fitted in the mating connector and the cam boss is in contact with the cam groove.

FIGS. 8A and 8B are explanation views that describe the movement of the locking protrusion and the cam boss in accordance with the rotation of the lever, wherein FIG. 8A shows a state in which the housing is pushed into the mating connector and the lever is moved from the temporary locking position to the fitting start position, and FIG. 8B shows a state in which the lever has been moved to the fitting completion position.

DETAILED DESCRIPTION OF THE EXEMPLARY EMBODIMENTS

Hereinafter, an embodiment of the present invention will be described with reference to the drawings.

Figure 1:
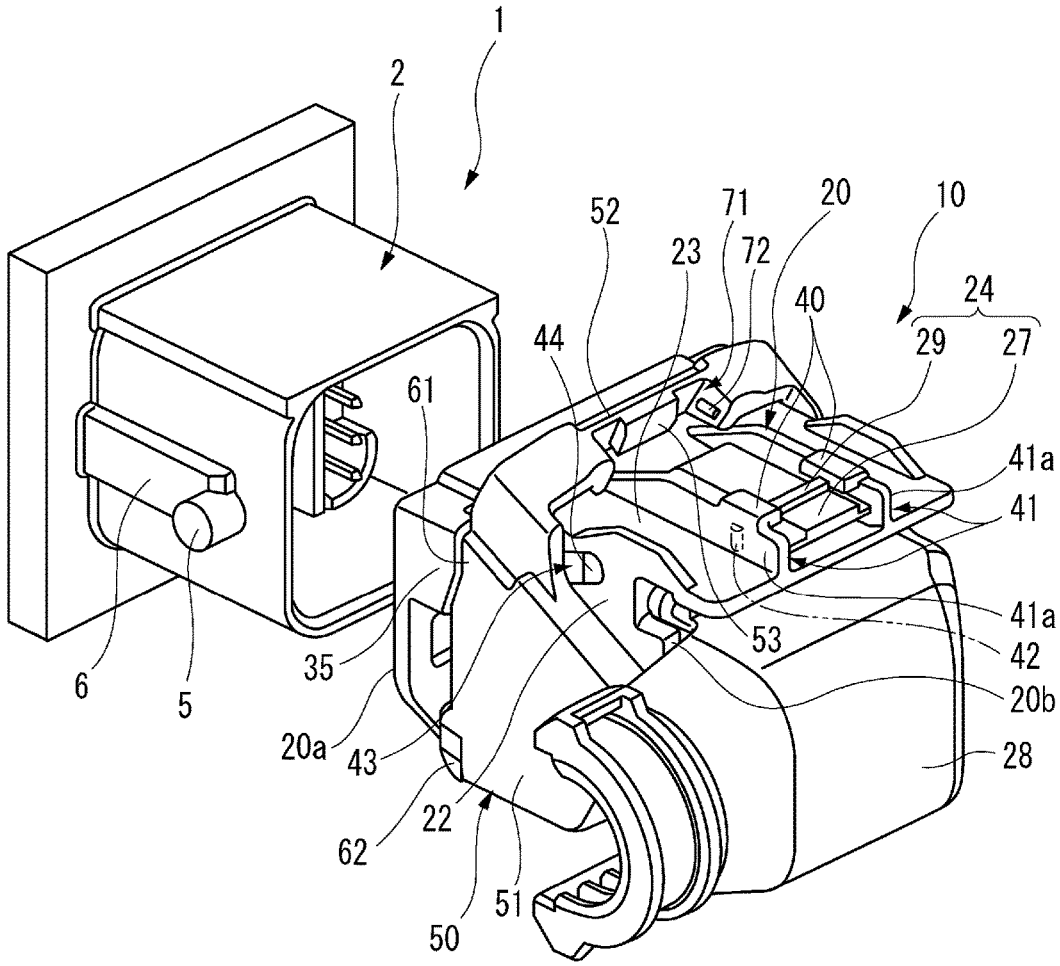
FIG. 1 is a perspective view of a lever-type connector according to an embodiment of the present invention viewed from the rear before being fitted to a mating connector.
Figure 2:
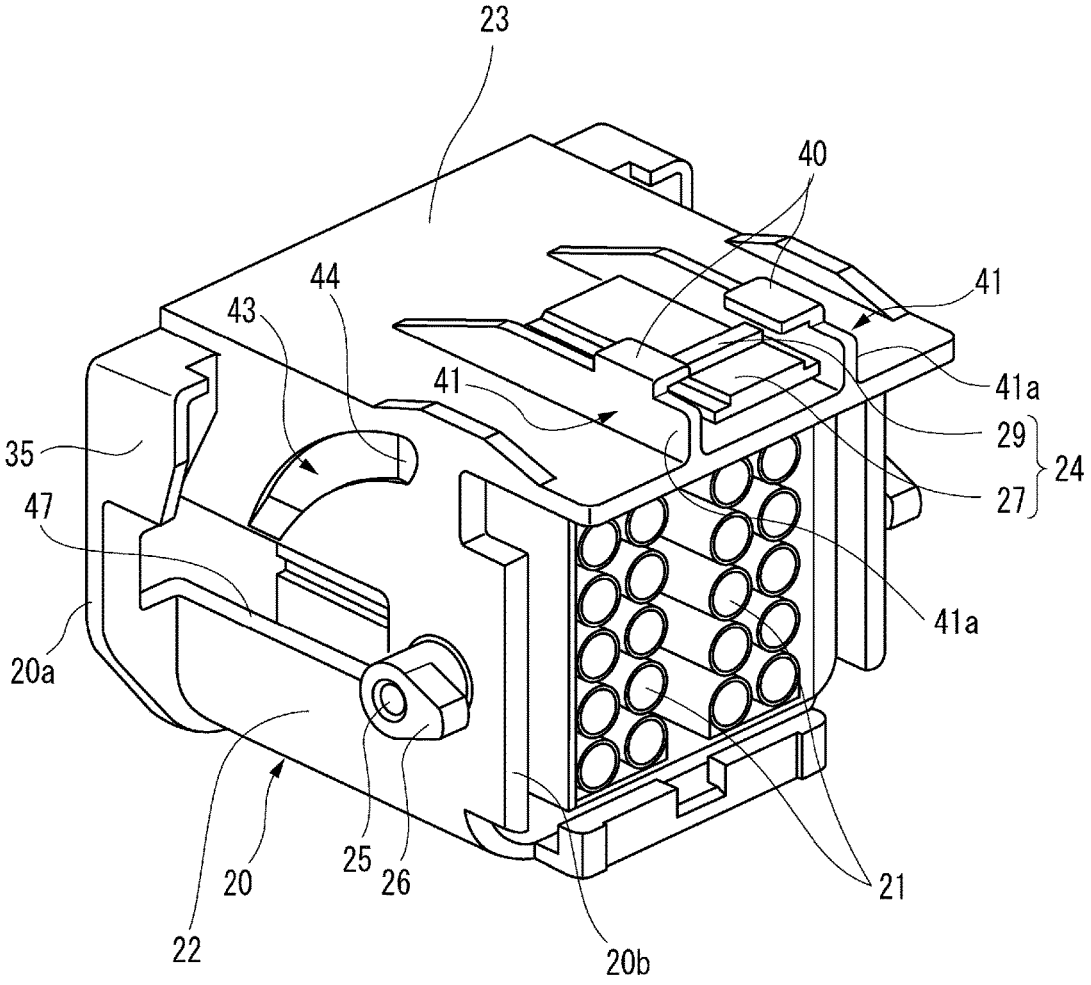
FIG. 2 is a perspective view of the housing shown in FIG. 1.
Figure 3A:
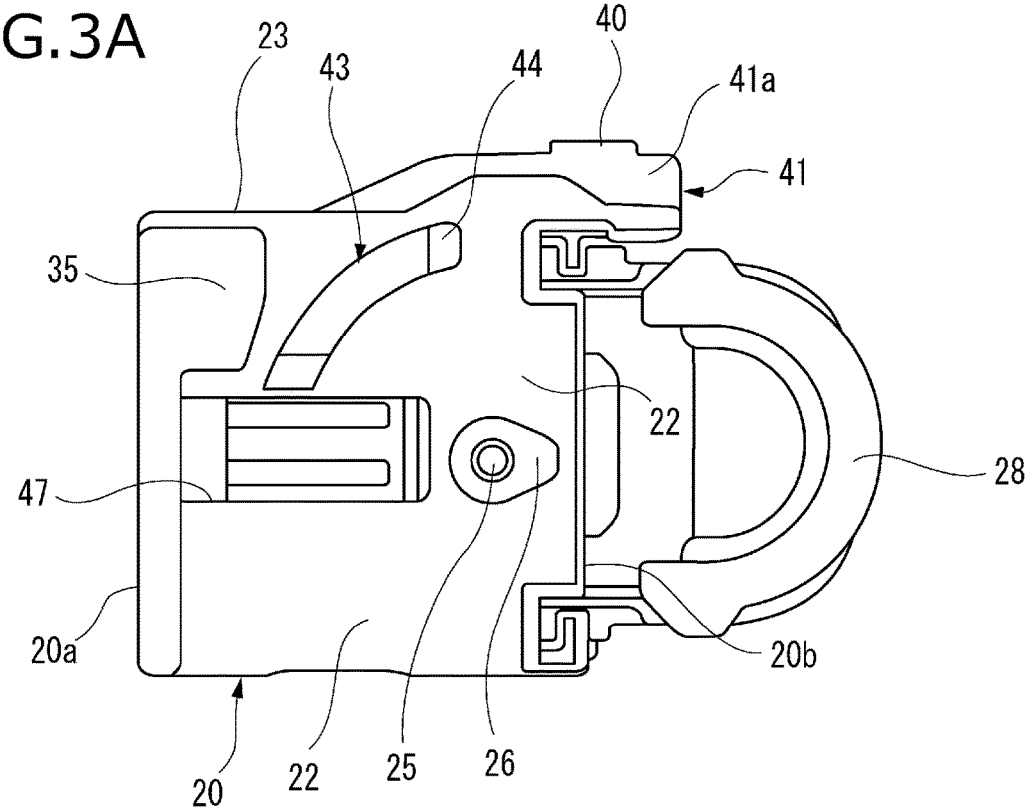
FIG. 3A is a side view of the housing shown in FIG. 2.
Figure 3B:
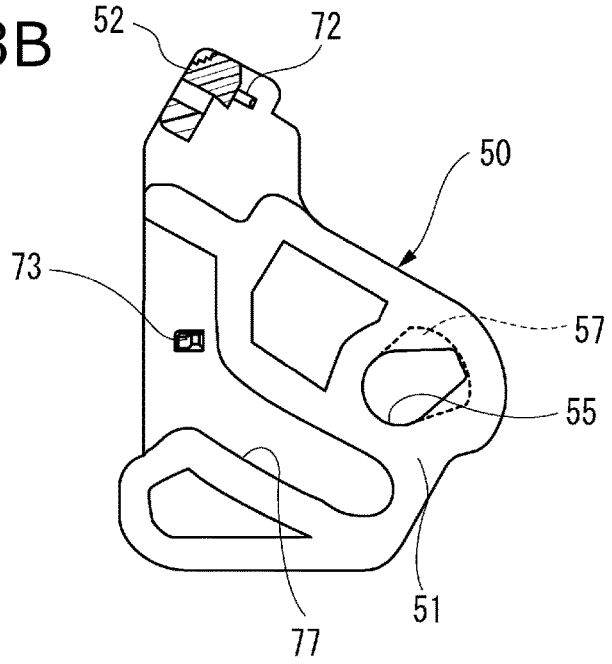
FIG. 3B is a cross sectional view illustrating an inner surface of a side plate of the lever shown in FIG. 1.

FIG. 1 is a perspective view of a lever-type connector 10 according to an embodiment of the present invention viewed from the rear before being fitted to a mating connector 1. FIG. 2 is a perspective view of the housing 20 shown in FIG. 1. FIG. 3A illustrates a side view of the housing 20 shown in FIG. 2, and FIG. 3B is a cross sectional view illustrating the inner surface of the side plate 51 of the lever 50 shown in FIG. 1.

As shown in FIGS. 1 to 3B, the lever-type connector 10 according to the present embodiment includes a housing 20 and a lever 50. The lever-type connector 10 is fitted to the mating connector 1 by fitting the mating housing 2 and the housing 20 to each other. The lever 50 has a pair of side plates 51 arranged along the surface on both sides 22 of the housing 20 and an operating portion 52 connecting the ends of the side plates 51. The lever 50 is rotatable around an axis in the horizontal direction with respect to the housing 20.

Figure 6:
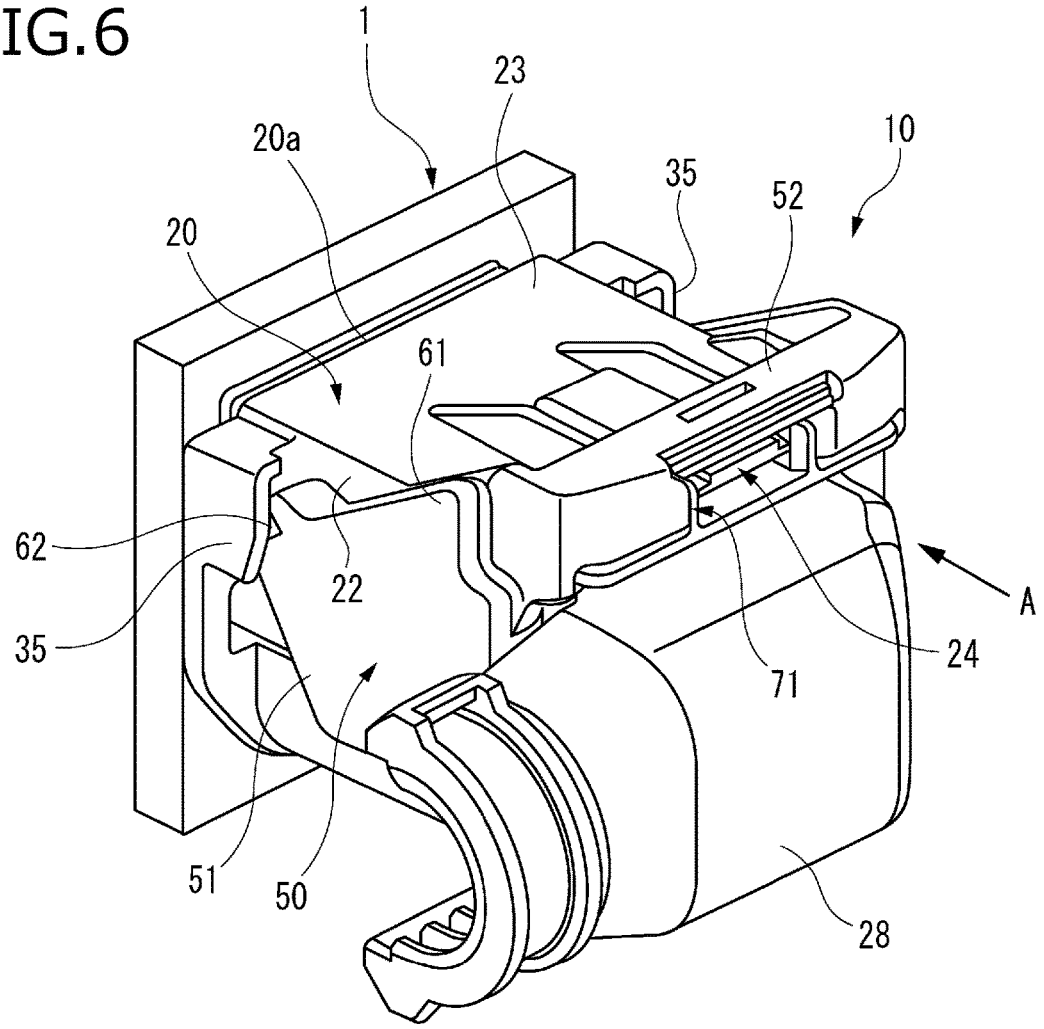
FIG. 6 is a perspective view of the lever-type connector in a state where the lever has moved to a fitting completion position.

The lever 50 is rotated between a temporary locking position (see FIG. 1) and a fitting completion position (see FIG. 6). The housing 20 has a lock portion 24 for locking the operating portion 52 of the lever 50 on the upper surface 23 of the housing 20. The lever 50 locks into the fitting completion position by the lock portion 24 when the operating portion 52 is engaged and locked to the lock portion 24. The lever-type connector 10 is assisted in fitting to and detaching from the mating connector 1 by rotation of the lever 50. That is, the lever-type connector 10 is an LIF (Low Insertion Force) connector that is fitted to the mating connector 1 with a low insertion force by operation of the lever 50.

The housing 20 is made of insulating synthetic resin, and a front part 20*a* of the housing 20 is fitted to the mating housing 2 of the mating connector 1. The housing 20 has a plurality of terminal accommodating chambers 21. These terminal accommodating chambers 21 are formed along a direction of fitting with the mating connector 1, and terminals (not shown) connected to electrical wires (not shown) are accommodated in the respective terminal accommodating chambers 21. Electrical wires connected to terminals accommodated in the terminal accommodating chambers 21 are pulled out from the rear part 20*b* of the housing 20. An electrical wire cover 28 is attached to the rear part 20*b* of the housing 20, and the electrical wires pulled out from the rear part 20*b* of the housing 20 are covered with the electrical wire cover 28 and are bundled and pulled out in one direction (lateral direction in this example). By fitting the lever-type connector 10 into mating connector 1, terminals accommodated in the terminal accommodating chambers 21 of the housing 20 are electrically connected to the terminals provided in the mating housing 2 of the mating connector 1.

As shown in FIGS. 2 and 3A, a support shaft 25 protrudes from the surface of each of both sides 22 of the housing 20. As shown in FIG. 3B, the lever 50 has a pivot hole 55 in respective one of its side plates 51, and the support shafts 25 of the housing 20 are respectively inserted through the pivot holes 55. As a result, the lever 50 is rotatable about the support shafts 25 inserted through the pivot holes 55 of the side plates 51. A locking piece 26 that extends rearward of the housing 20 with intersecting the support shaft axis is formed at the tip of each of the support shafts 25.

Also, in each of the side plates 51, the pivot hole 55 has a shape corresponding to the outer shape of the locking piece 26, the locking piece 26 can only be inserted through when the lever 50 is disposed between the temporary locking position and fitting completion stop position and the locking piece 26 is aligned with the shape of the pivot hole 55. The locking piece 26 inserted into the pivot hole 55 prevents the side plate 51 from coming off, when the locking piece 26 is in a range corresponding to a locking recess portion 57 that is formed in the outer surface of the side plate 51.

Figure 4A:
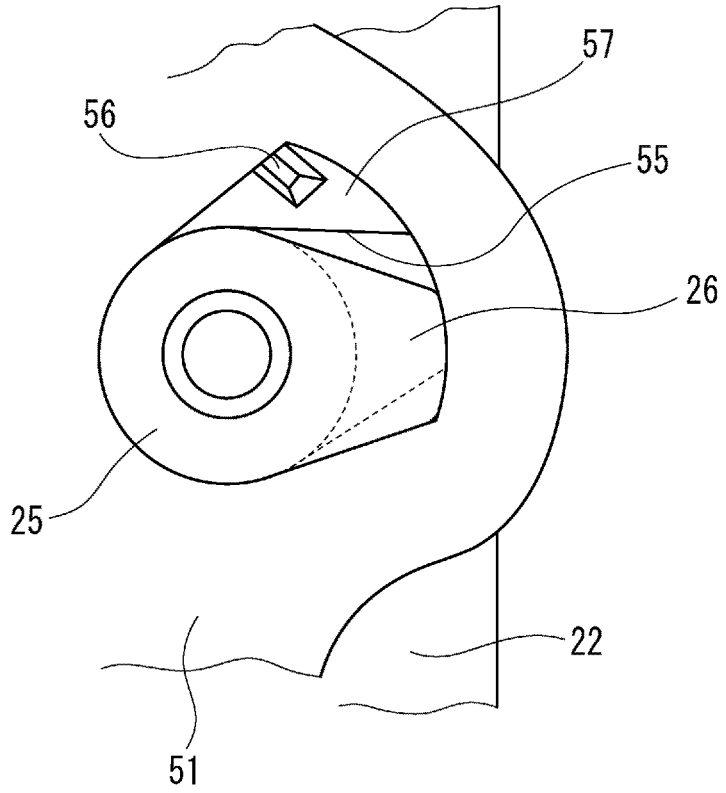
Figure 4B:
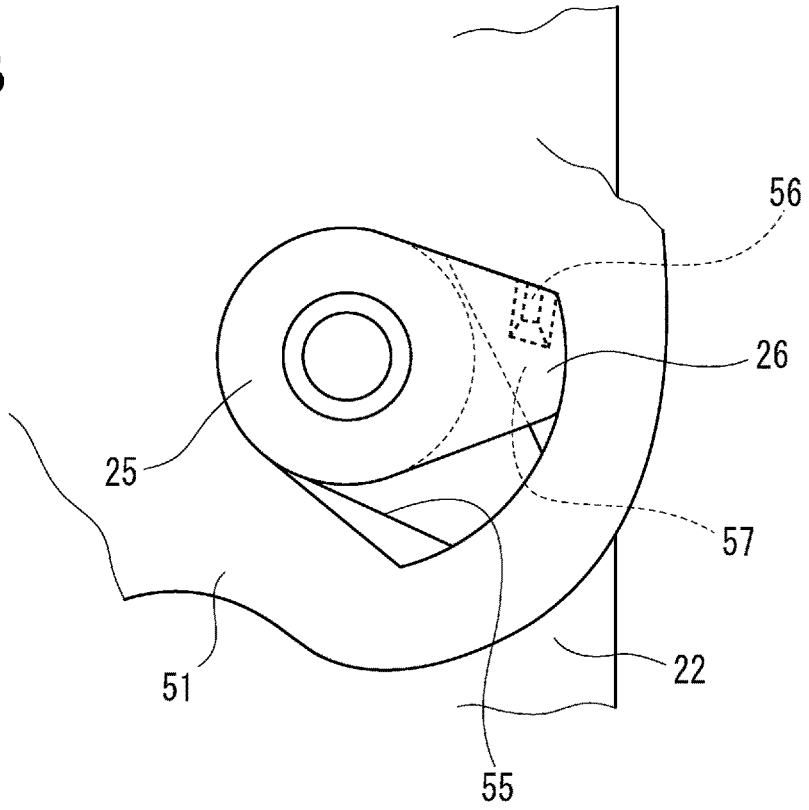
Figure 5:
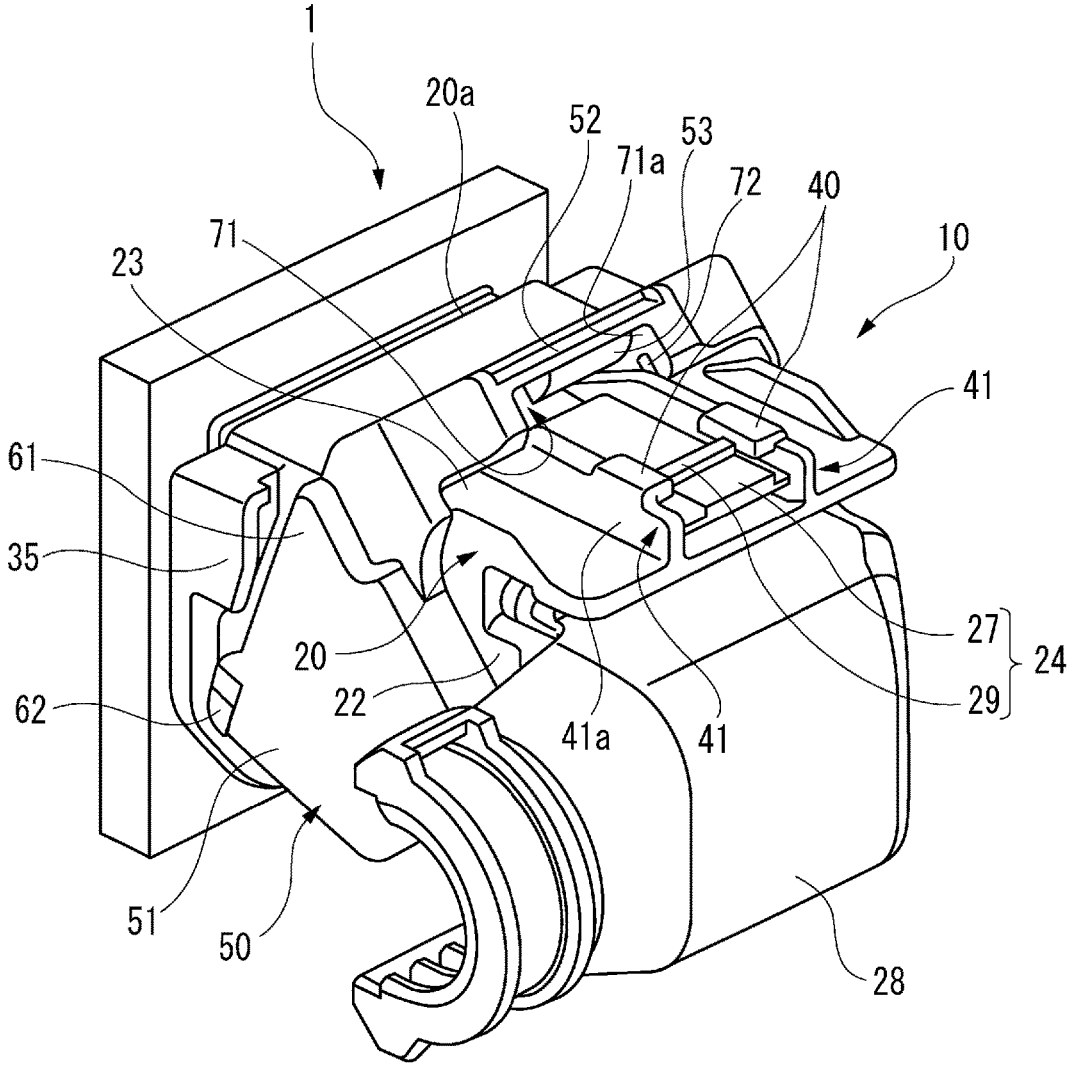
FIG. 5 is a perspective view of the lever-type connector in a state where the housing is fitted in the mating housing and the lever has moved to a fitting start position.

Further, as shown in FIGS. 4A and 4B, on the bottom surface of the locking recess 57 in the vicinity of the pivot hole 55, a pressed protrusion 56 is formed. The side plate 51 is moved toward the side surface 22 by the pressed protrusion 56 that is pressed by the inner surface of the locking piece 26 when the lever 50 is moved to the fitting completion position.

As shown in FIG. 4A, when the lever 50 is positioned at the temporary locking position, the locking piece 26 of the support shaft 25 overlaps a part of the locking recess portion 57. As a result, in a state in which the side plate 51 of the lever 50 is disposed to the temporary locking position, the locking recess portion 57 is locked to the locking piece 26. Also, as shown in FIG. 4B, even when the lever 50 is disposed to the fitting completion position, the locking piece 26 of the support shaft 25 overlaps a part of the locking recess portion 57. As a result, even in a state where the side plate 51 of the lever 50 is disposed to the fitting completion position, the locking recess portion 57 is locked to the locking piece 26.

As shown in FIG. 3A, a guide grooves 47 are formed on both sides 22 of the housing 20 and open up toward the front part 20*a* side. The guide grooves 47 are formed along the front-rear direction of the housing 20. When the housing 20 is fitted to the mating housing 2, the cam bosses 5 and the guide protrusions 6 (see FIG. 1) on both side surfaces of the mating housing 2 are inserted in the guide grooves 47.

As shown in FIG. 3B, a cam groove 77 is formed on the inner surface of the side plate 51 of the lever 50 facing the side surface 22 of the housing 20. The cam groove 77 is open on the front side of the lever 50 in a state of being moved to the temporary locking position and extends obliquely downward toward the rear side of the side plate 51. When the housing 20 is fitted to the mating housing 2, the cam boss 5 of the mating housing 2 enters the cam groove 77 (see FIG. 7B). Then, when the lever 50 is rotated from this state toward the fitting completion position, the cam groove 77 of the lever 50 rotates, and the cam boss 5 entering the cam groove 77 is retracted in the cam groove 77 (refer to FIGS. 8A and 8B). As a result, the housing 20 and the mating housing 2 are drawn to each other and fitted together.

Figure 7A:
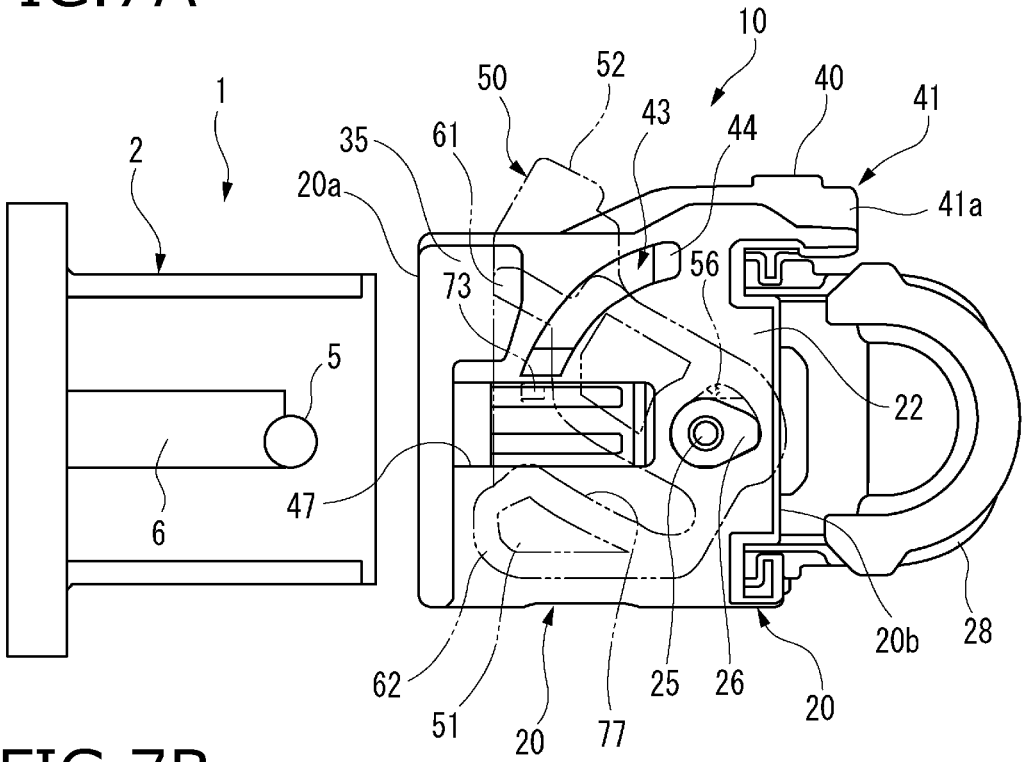

On the inner surface of the side plate 51 of the lever 50, a locking protrusion 73 is formed for locking the lever 50 to the temporary locking position with respect to the housing 20. When the lever 50 is moved to the temporary locking position, the locking protrusion 73 is disposed in the guide groove 47 and is locked to the upper-edge portion of the guide groove 47 (see FIG. 7A).

On both sides 22 of the housing 20, there are escape grooves 43 in which the locking protrusions 73 are in a non-contact state when the lever 50 rotates. The escape groove 43 is formed in an arc shape with the support shaft 25 as its center. On one end (the upper end in FIG. 3A) of the escape groove 43, a final locking surface 44 is formed. The locking surface 44 is a tapered surface in which the bottom surface of the groove gradually becomes shallower toward the upper-end portion of the escape groove 43.

Therefore, when the lever 50 is rotated toward the fitting completion position, the locking protrusion 73 goes over the upper-edge portion of the guide groove 47, is guided into the escape groove 43, and moves through the escape groove 43. When the lever 50 is rotated, by way of the locking protrusion 73 on the inner surface of the side plate 51 of the lever 50 moving through the escape groove 43 on the side surface 22 of the housing 20, the lever 50 smoothly rotates in a predetermined direction without the locking protrusion 73 coming into contact with the side surface 22 of the housing 20.

Figure 8A:
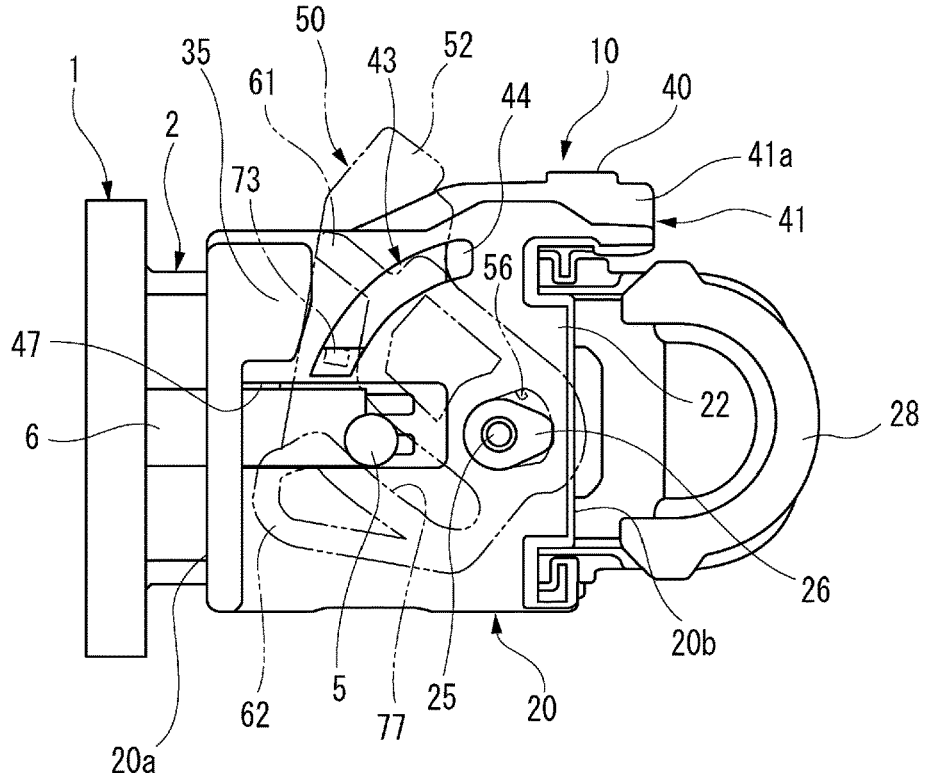
Figure 8B:
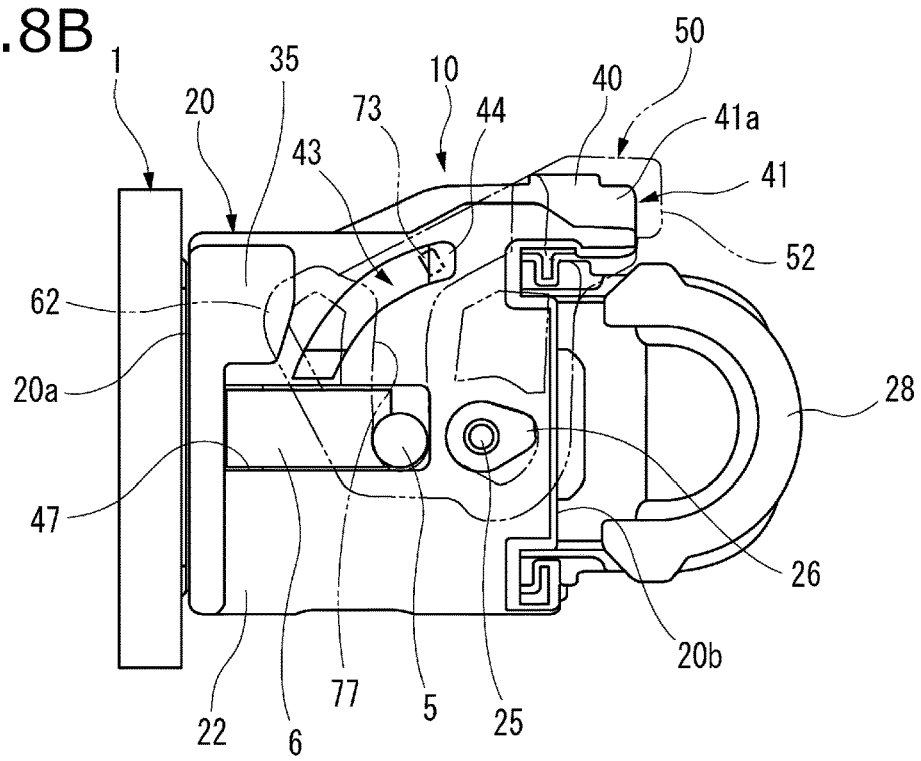

When the lever 50 reaches the fitting completion stop position, the locking protrusion 73 of the side plate 51 rides on the final locking surface 44 having a tapered surface and suppresses backlash of the lever 50 (see FIG. 8B).

A locking protrusion 73 and an escape groove 43 do not need to be provided on both side plates 51 and both sides 22; they may be provided only on one of the side plates 51 and sides 22.

As shown in FIGS. 1 and 2, the housing 20 has a lever-disengagement prevention portion 35. The lever-disengagement prevention portion 35 is provided at the upper position on both sides of the housing 20, and is formed so as to extend rearward along both sides 22 from the front part 20*a*. The lever 50 has an upper-edge portion 61 and a vibration-suppressing protrusion 62 on a part of the side plate 51.

In a state where the lever 50 is moved to the temporary locking position, the upper-edge portion 61 of the side plate 51 facing the lever-disengagement prevention portion 35 goes inside the lever-disengagement prevention portion 35 (see FIG. 1). By way of the lever 50 moving to the temporary locking position, the upper-edge portion 61 is covered from the outside by the lever-disengagement prevention portion 35, and the side plate 51 is prevented from being detached from the housing 20.

In a state where the lever 50 is moved to the fitting completion position, the vibration-suppressing protrusion 62 goes inside the lever disengagement prevention portion 35 (see FIG. 6). When the lever 50 is moved to the fitting completion position, the vibration-suppressing protrusion 62 of the side plate 51 is covered from the outside by the lever-disengagement prevention part 35 and the inner surface of the lever-disengagement prevention part 35 is pressed against the vibration-suppressing protrusion 62 thereby eliminating backlash of the side plate 51 with respect to the lever-disengagement prevention portion 35. It is sufficient if the inner surface of the lever-disengagement prevention portion 35 is in contact with the vibration-suppression protrusion 62. An inner face of the lever-disengagement prevention portion 35 need not be pressurized by the vibration-suppressing protrusion 62 as long as they are in a state in which there are no gaps.

As shown in FIGS. 1 and 2, the lock portion 24 provided on the upper surface 23 of the housing 20 has a flexible arm portion 27 and an engaging portion 29. When the lever 50 is moved to the fitting completion position, the engaging portion 29 locks the lock portion 53 protruding from the operating portion 52. As a result, the lock portion 53 of the lever 50 is locked to the engaging portion 29 of the lock portion 24 so that rotation of the lever 50 is restricted with respect to the housing 20, which is so called as a locked state.

A pair of walls 41 stand upright on the upper surface 23 of the housing 20 and are arranged on both sides of the lock portion 24 for locking the operating portion 52. Further, on the upper edge of each wall 41, an arm protection wall 40 extends inward so as to cover both sides of the flexible arm portion 27. Accordingly, since the lock portion 24 is surrounded by the pair of walls 41 and the arm protection wall 40, the flexible arm portion 27 is prevented from deformation due to being undesirably pressed on before fitting the connector.

Figure 9:
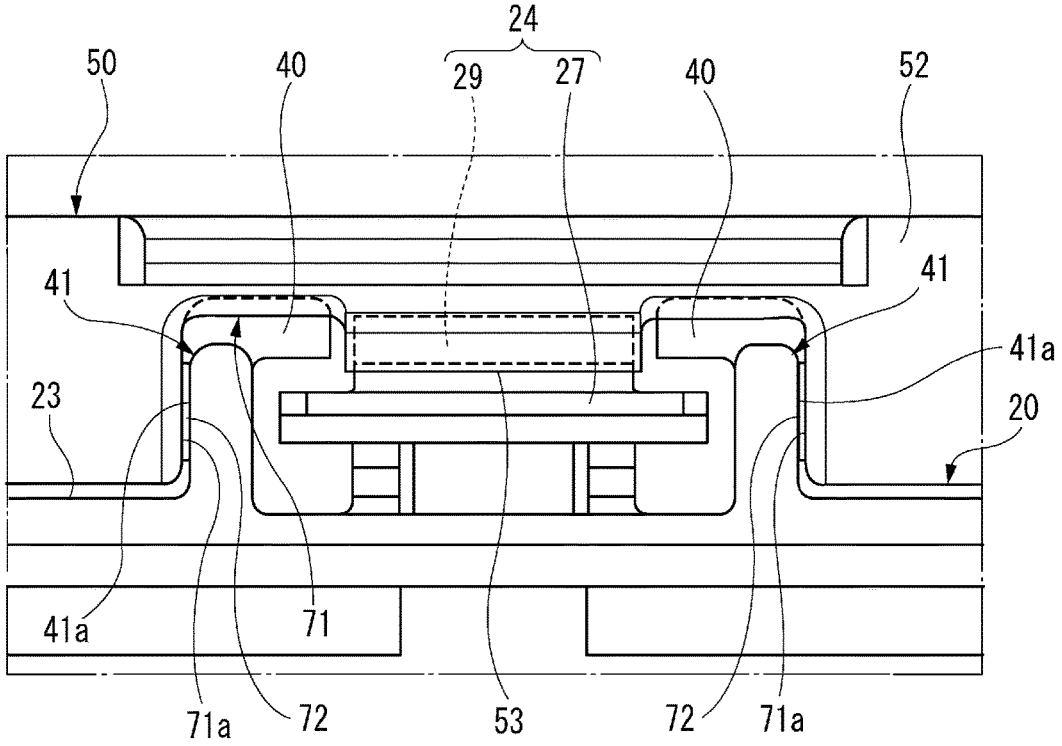
FIG. 9 is an enlarged view of the lock portion of the housing for locking the operating portion of the lever moved to the fitting completion position as viewed in the direction of arrow A in FIG. 6.

Furthermore, as shown in FIG. 9, since the arm protection walls 40 are extended so as to cover and, thereby, overlap upper portions of both sides of the flexible arm portion 27, in the event that the flexible arm portion 27 is undesirably lifted up, deformation of the flexible arm portion 27 can be prevented by bringing the two sides in contact with the arm protection walls 40.

Furthermore, there are recessed portions 71 which can externally fit the pair of walls 41 in the operating portion 52 of the lever 50. When the lever 50 is moved to the fitting completion position, the inner surfaces 71*a* of the recessed portions 71 contact the opposing outer surfaces 41*a* of the pair of walls 41, respectively. That is, the recessed portions 71 of the operating portion 52 are externally fitted to the pair of walls 41 without gaps (a state of no gaps or pressurized contact). With backlash-eliminating protrusions 72 protruding inward and being provided on the inner surfaces 71*a* of the recessed portions 71 of the present embodiment, the backlash-eliminating protrusions 72 are compressed and deformed and the recessed portions 71 of the operating portion 52 are brought into pressurized contact with the pair of walls 41 (see FIGS. 1 and 9). As shown by the dashed line in FIG. 1, backlash-eliminating protrusions 42 protruding outward can also be provided on the outer surfaces 41*a* of the pair of walls facing the inner surfaces 71*a* of the recessed portions 71.

Therefore, the operating portion 52 of the lever 50 that is engaged and locked to the lock portion 24 in the fitting completion position is restrained from backlash against the upper surface 23 of the housing 20. As a result, even if an external force such as vibration or shock is applied to the lever, the operating portion 52 can be engaged and locked by the lock portion 24, thus high fitting reliability with the mating connector 1 can be achieved.

Next, a case where the lever-type connector 10 is fitted to the mating connector 1 will be described.

FIGS. 7A to 8B are views for describing the movement of the locking projection 73 and cam boss 5 by rotation of the lever 50.

First, the lever 50, temporarily engaged in the temporary locking position, is pivoted toward the fitting start position so that the lever 50, disposed so as to overlap the lever-protection wall 30, separates from the lever-protection wall 30.

Figure 7B:
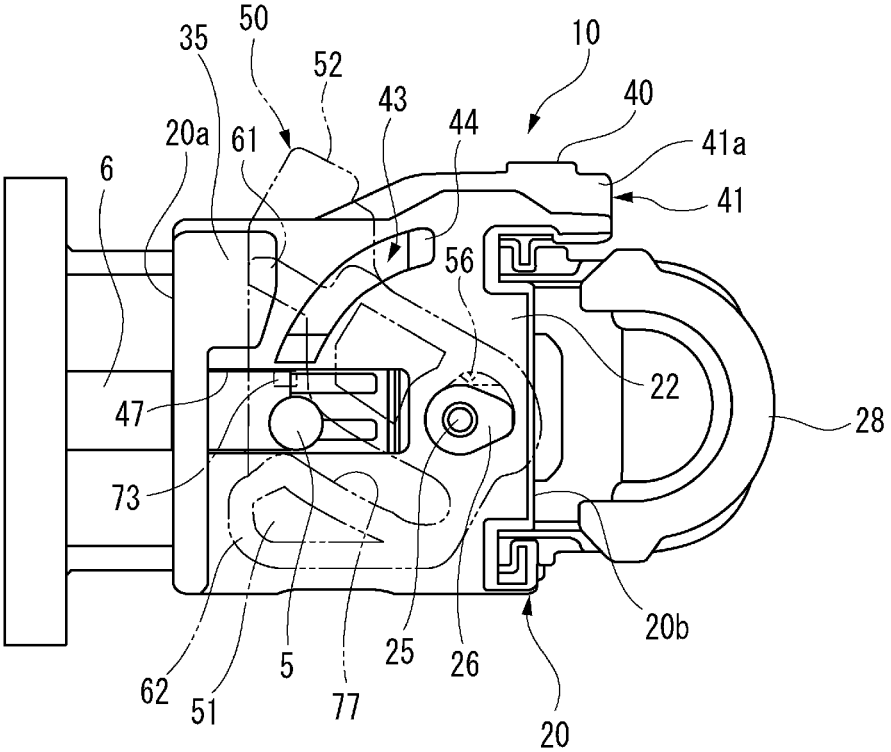

As shown in FIG. 7B, when the housing 20 is fitted to the mating housing 2 and the cam boss 5 and the guide protrusion 6 of the mating housing 2 are inserted into the guide groove 47 of the housing 20, the cam boss 5 abuts on the cam groove 77 of the lever 50. When the housing 20 is further pushed into the mating housing 2, the cam boss 5 of the mating housing 2 is pushed into the cam groove 77 of the lever 50, and the lever 50 is rotated toward the fitting start position by the pushing force. From this, the locking protrusion 73 of the side plate 51 of the lever 50 is released from engagement with the upper edge portion of the guide groove 47 and enters the escape groove 43.

Then, as shown in FIG. 8A, the lever 50 temporarily engaged in the temporary locking position is moved to the fitting start position. In this state, the operating portion 52 of the lever 50 is grasped and the lever 50 is rotated to the fitting completion position. Consequently, the cam boss 5 of the mating housing 2 is retracted into the cam groove 77 of the lever 50, and as shown in FIG. 8B, the housing 20 and the mating housing 2 are fitted to each other, the lever-type connector 10 is fitted to the mating connector 1, and the terminals are electrically connected.

When the lever 50 is moved to the fitting completion position, the lock portion 53 of the operation portion 52 is engaged and locked to the engaging portion 29 of the lock portion 24, and the rotation of the lever 50 relative to the housing 20 is restricted in the locked state. In addition, in the lock portion 24, the outer surfaces 41*a* of the pair of walls 41 compress and deform the backlash-eliminating protrusions 72 protruding from the outer surfaces 71*a* of the recessed portions 71 so as to be externally fitted without gaps (see FIG. 9). From this, the lever 50 suppresses backlash of the operating portion 52 that is engaged and locked to the lock portion 24 in the fitting completion position.

When the lever 50 is moved to the fitting completion position, the vibration-suppressing protrusion 62 of the side plate 51 enters the inside of the lever-disengagement prevention portion 35. Consequently, the vibration-suppressing protrusion 62 of the side plate 51 is covered from the outside by the lever-disengagement prevention portion 35 and the inner surface of the lever disengagement prevention portion 35 is brought into pressurized contact with the vibration-suppressing protrusion 62 (see FIG. 6). As a result, backlash of the side plate 51 with respect to the lever-disengagement prevention portion 35 of the lever 50 is suppressed.

Further, when the lever 50 is rotated to the fitting completion position, the locking protrusion 73 protruding from the inner surface of each of the side plates 51 passes through the corresponding one of the escape grooves 43 and rides on the corresponding final locking surface 44 having a tapered surface. As a result, backlash of the side plate 51 with respect to the side surface 22 of the housing 20 is suppressed in the lever 50.

When the lever 50 is rotated to the fitting completion position, the pressed protrusion 56 projecting from the outer surface of the side plate 51 is pressed toward the side surface 22 by the inner surface of the locking piece 26 of the support shaft 25, backlash of the side plate 51 with respect to the support shaft 25 of the housing 20 is suppressed in the lever 50 (see FIGS. 4A and 4B).

In this way, in the lever-type connector 10 of the present embodiment, the operating portion 52 of the lever 50 is held and the lever 50 is rotated by the operator, thereby the insertion force of the housing 20 applied to the mating housing 2 is assisted through the cam mechanism constituted by the cam groove 77 and cam boss 5.

As described above, in the lever-type connector 10 according to the present embodiment, when the housing 20 is fitted into the mating housing 2 and the lever 50 at the fitting start position is rotated and moved to the fitting completion position, the housing 20 is fitted to the mating housing 2 and the lever 50 is engaged and locked to the lock portion 24.

In this state, since the vibration suppressing protrusions 62, which are a part of the side plates 51 of the lever 50, are covered from the outside by the lever-disengagement prevention portions 35 provided on both sides of the housing 20, disengagement of the side plate 51 from the housing 20 is prevented in the lever 50 that is engaged and locked to the lock portion 24 in the fitting completion position. As a result, even if an external force such as vibration or shock is applied to the lever 50, the lever 50 can be engaged and locked by the lock portion 24, thus high fitting reliability with the mating connector 1 can be achieved.

When the lever 50 is moved to the fitting completion position, the inner surface of the lever-disengagement prevention portion 35 is pressed against the vibration suppressing protrusions 62 provided on the side plate 51 of the lever 50. The lever 50, in which the side plates 51 do not rattle with respect to the lever disengagement prevention portion 35, does not generate abnormal noise even when vibrations are applied.

Moreover, when the lever 50 is moved to the fitting completion position, the recessed portions 71 of the lever 50 are externally fitted to the walls 41 on both sides of the lock portion 24 without any gaps. Therefore, backlash of the operating portion 52 of the lever 50 that is engaged and locked to the lock portion 24 in the fitting completion position can be further suppressed. As a result, even if an external force such as vibration or shock is applied, the lever 50 can be engaged and locked by the lock portion 24, thus high fitting reliability with the mating connector 1 can be achieved. Furthermore, there are backlash-eliminating protrusions 72 projected from the inner surfaces 71*a* of the recessed portions 71. When the lever 50 is placed in the fitting completion position, the backlash-eliminating protrusions 72 protruding from the inner surfaces 71*a* of the recessed portions 71 are compressed and deformed in a state where the recessed portions 71 of the operating portion 52 are pressed against the pair of walls 41. Therefore, with the simple backlash-eliminating protrusions 72 that are easily compressed and deformed, backlash of the operating portion 52 of the lever 50 that is engaged and locked to the lock portion 24 in the fitting completion position can be easily suppressed.

Furthermore, in the lever-type connector 10 according to the present embodiment, the locking protrusions 73 on the inner surfaces of the side plates 51 of the lever 50 can lock the lever 50 to the housing 20 in the temporary locking position. Therefore, it is possible to prevent careless rotation of the lever 50 before fitting to the mating connector 1 and eliminate complicated operations in returning the carelessly rotated lever 50 to the temporary locking position, thus, making it possible to smoothly perform the fitting to the mating connector 1.

When rotating the lever 50, by way of the locking projection 73 on the inner surface of the side plate 51 of the lever 50 passing through the escape groove 43 formed in the side surface 22 of the housing 20, the lever 50 is smoothly pivoted in a predetermined direction without the locking protrusion 73 coming in contact with the side surface 22 of the housing 20. Then, when the lever 50 is moved to the fitting completion position, the locking protrusion 73 of the lever rides on the locking surface 44 of the escape groove 43 and suppresses backlash of the lever 50. As a result, even if an external force such as vibration or shock is applied, the lever 50 can be engaged and locked by the lock portion 24 more securely, thus high fitting reliability with the mating connector 1 can be achieved.

Further, when the lever 50 is moved to the fitting completion position, the inner surface of the locking piece 26 of the support shaft 25, projecting from both sides 22 of the housing 20, presses the pressed protrusion 56, protruding from the bottom surface of the locking recess portion 57 in the vicinity of the pivot hole 55 in the side plate 51 of the lever 50, against the side surface 22. Therefore, in the side plates 51 of the lever 50, backlash of the support shaft 25 of the housing 20 is suppressed, and generation of noise from vibrations are prevented.

Since the locking protrusion 73 of the lever 50 is disposed inside the escape groove 43 when the lever 50 is in the middle of a rotation, the locking projection 73 does not receive the counter force from the side surface 22 of the housing 20. Therefore, the side plate 51 cannot float away. Also, when the opening of the pivot hole 55 in the middle rotation of the lever 50 overlaps and is aligned with the locking piece 26 of the support shaft 25, it is not possible for the support shaft 25 to come out of the pivot hole 55.

The present invention is not limited to the embodiment described above, and suitable modifications, improvements and so on can be made. Furthermore, the material, shape, dimensions, number, disposition, etc. of each component in the above embodiment is not limited as long as it can achieve the present invention.

Here, characteristics of the embodiment of the lever-type connector according to the present invention described above will be briefly summarized below in [1] to [6].

[1] A lever-type connector (10), including:

a housing (20) configured to be inserted and removed from a mating housing (2) of a mating connector (1);

a lever (50), pivotally mounted on the housing, and that is pivotally operable between a temporary locking position and a fitting completion position of the lever, the lever including:

a pair of side plates (51) arranged along surfaces on both sides (22) of the housing; and an operating portion (52) that connects ends of the side plates; and a lock portion (24) provided on the housing (20), and that locks the lever positioned at the fitting completion position, wherein the housing is configured to be fitted to the mating housing by rotating the lever from a fitting start position to a fitting completion position; and wherein lever disengagement prevention portions (35) are provided on both sides of the housing so as to cover at least respective parts of the side plates (upper edge 61 and the vibration suppressing projection 62) of the lever positioned at the fitting completion position from outside.

[2] The lever-type connector (10) according to [1], wherein inner surfaces of the lever-disengagement prevention portions (35) respectively contact with the vibration-suppressing protrusions (62) provided on the side plates (51) of the lever when the lever (50) is positioned at the fitting completion position.

[3] The lever-type connector (10) according to [1] or [2], wherein the housing (20) has a pair of walls (41) that are provided at both sides of the lock portion (24) for engaging and locking the operating portion (51) of the lever;

wherein recessed portions (71) that externally fit the pair of walls of the housing are formed on the operating portion (51) of the lever; and wherein the inner surfaces (71*a*) of the recessed portions contact outer surfaces (41*a*) of the pair of walls facing the inner surfaces, respectively when the lever (50) is positioned at the fitting completion position.

[4] The lever-type connector (10) according to [3], wherein a backlash-eliminating protrusion (71, 42) is provided on either the inner surface (71*a*) of the recessed portion (71) or the outer surface (41*a*) of the pair of walls (41).

[5] The lever-type connector (10) according to any one of [1] to [4], wherein locking protrusions (73) are formed on inner surfaces of the side plates of the lever so as to lock the lever to the temporary locking position with respect to the housing (20);

wherein escape grooves (43) are formed on both sides (22) of the housing so that the locking protrusions are in a non-contact state with the housing when the lever is rotated; and wherein ends of the escape grooves have final locking surfaces (44) respectively on which the locking protrusions ride and are engaged when the lever is moved to the fitting completion position.

[6] The lever-type connector according to any one of [1] to [5], wherein locking pieces (26) are provided at tip ends of the support shafts (25), projecting from both sides (22) of the housing (20), to pivotally support the lever (50), the locking pieces extending in directions intersecting axes of the support shafts;

wherein each of a pivot holes (55) through which the locking piece is inserted and having an opening shape corresponding to outer shape of the locking piece is provided in respective one of the side plates to pivotally support the support shafts; and wherein pressed protrusions, configured to be pressed by inner surfaces of the locking pieces (56) when the lever is moved to the fitting completion position, are provided adjacent to the pivot holes of the lever.

What is claimed is:

1. A lever-type connector, comprising:

a housing configured to be inserted and removed from a mating housing of a mating connector;

a lever, pivotally mounted on the housing, and that is pivotally operable between a temporary locking position and a fitting completion position of the lever, the lever comprising:

a pair of side plates arranged along surfaces on both sides of the housing; and an operating portion that connects ends of the side plates; and a lock portion, provided on the housing, and that locks the lever positioned at the fitting completion position, wherein the housing is configured to be fitted to the mating housing by rotating the lever from a fitting start position to the fitting completion position;

wherein lever disengagement prevention portions are provided on both sides of the housing and configured to receive at least respective parts of the side plates of the lever; and wherein the at least respective parts of the side plates of the lever are received in the lever disengagement prevention portions so that the at least respective parts of the side plates of the lever are covered by the lever disengagement prevention portions from outside in a state where the lever is positioned at the fitting completion position.

2. The lever-type connector according to claim 1, wherein in the state where the lever is positioned at the fitting completion position, vibration-suppressing protrusions provided on the side plates of the lever are received in the lever disengagement prevention portions so that inner surfaces of the lever-disengagement prevention portions respectively contact the vibration-suppressing protrusions.

3. The lever-type connector according to claim 1, wherein the housing has a pair of walls that are provided at both sides of the lock portion for locking the operating portion of the lever;

wherein recessed portions that externally fit the pair of walls of the housing are formed on the operating portion of the lever; and wherein inner surfaces of the recessed portions contact outer surfaces of the pair of walls facing the inner surfaces respectively when the lever is positioned at the fitting completion position.

4. A lever-type connector, comprising:

a housing configured to be inserted and removed from a mating housing of a mating connector;

a lever, pivotally mounted on the housing, and that is pivotally operable between a temporary locking position and a fitting completion position of the lever, the lever comprising:

a pair of side plates arranged along surface on both sides of the housing; and an operating portion that connects ends of the side plates; and a lock portion, provided on the housing, and that locks the lever positioned at the fitting completion position, wherein the housing is configured to be fitted to the mating housing by rotating the lever from a fitting start position to the fitting completion position;

wherein lever disengagement prevention portions are provided on both sides of the housing so as to cover at least respective parts of the side plates of the lever positioned at the fitting completion position from outside;

wherein locking protrusions are formed on inner surfaces of the side plates of the lever so as to lock the lever to the temporary locking position with respect to the housing;

wherein escape grooves are formed on both side surfaces of the housing so that the locking protrusions are in a non-contact state with the housing when the lever is rotated; and wherein ends of the escape grooves have final locking surfaces respectively on which the locking protrusions ride and are engaged when the lever is moved to the fitting completion position.

5. A lever-type connector, comprising:

a housing configured to be inserted and removed from a mating housing of a mating connector;

a lever, pivotally mounted on the housing, and that is pivotally operable between a temporary locking position and a fitting completion position of the lever, the lever comprising:

a pair of side plates arranged along surfaces on both sides of the housing; and an operating portion that connects ends of the side plates; and a lock portion, provided on the housing, and that locks the lever positioned at the fitting completion position, wherein the housing is configured to be fitted to the mating housing by rotating the lever from a fitting start position to the fitting completion position; and wherein lever disengagement prevention portions are provided on both sides of the housing so as to cover at least respective parts of the side plates of the lever positioned at the fitting completion position from outside;

wherein locking pieces are provided at tip ends of support shafts, projecting from both sides of the housing, to pivotally support the lever, the locking pieces extending in directions intersecting axes of the support shafts;

wherein each of pivot holes through which the locking piece is inserted and having an opening shape corresponding to outer shape of the locking piece are provided in respective one of the side plates to pivotally support the support shafts; and wherein pressed protrusions, configured to be pressed by inner surfaces of the locking pieces when the lever is moved to the fitting completion position, are provided adjacent to the pivot holes of the lever.

* * * * *